US006966477B1

(12) United States Patent
Chien-Kuo et al.

(10) Patent No.: US 6,966,477 B1
(45) Date of Patent: Nov. 22, 2005

(54) SAFETY DEVICE FOR PREVENTING A NAILER FROM DRY FIRING

(75) Inventors: Po Chien-Kuo, Taichung (TW); Chang Shin-Nan, Taichung (TW); Wu Kun-Ta, Taichung (TW)

(73) Assignee: Basso Industry Corp, Taichung (TW)

( * ) Notice: Subject to any disclaimer, the term of this patent is extended or adjusted under 35 U.S.C. 154(b) by 0 days.

(21) Appl. No.: 10/988,784

(22) Filed: Nov. 15, 2004

(51) Int. Cl.[7] ..... B27F 7/17; B25C 1/04
(52) U.S. Cl. ..... 227/8; 227/120
(58) Field of Search ..... 227/8, 120, 130, 227/142

(56) References Cited

U.S. PATENT DOCUMENTS 4,597,517 A * 7/1986 Wagdy ..... 227/8
4,932,580 A * 6/1990 Pfister et al. ..... 227/10
6,056,181 A * 5/2000 Chuang ..... 227/8
6,149,046 A * 11/2000 Ho et al. ..... 227/8
6,199,739 B1 * 3/2001 Mukoyama et al. ..... 227/8
6,209,770 B1 * 4/2001 Perra ..... 227/8
6,264,085 B1 * 7/2001 Ho et al. ..... 227/8
6,267,284 B1 * 7/2001 Clark ..... 227/8
6,708,860 B1 * 3/2004 Thieleke ..... 227/8
6,908,021 B1 * 6/2005 Wang ..... 227/8
6,913,179 B1 * 7/2005 Chen ..... 227/8

* cited by examiner

*Primary Examiner*—Scott A. Smith
(74) *Attorney, Agent, or Firm*—Charles E. Baxley

(57) ABSTRACT

The present invention relates to a safety device for preventing a nailer from dry firing, wherein the drive plate is provided with a rod which is used to push the safety piece, the safety piece acts as a leverage and the second end of the safety piece serves to work in conjunction with an end of the safety link. After all nails are fired (when no rails are loaded), the second end of the safety piece will move downward to stop the movement of the safety link so as to prevent the nailer from being fired. Thus, the service life of the nailer is prolonged. Moreover, the movement of the safety link is stopped indirectly by the safety piece, thereby preventing the deformation of the drive plate.

11 Claims, 7 Drawing Sheets

SAFETY DEVICE FOR PREVENTING A NAILER FROM DRY FIRING

BACKGROUND OF THE INVENTION

1. Field of the Invention

The present invention relates to a nailer, and more particularly to a safety device for preventing the nailer form dry firing.

2. Description of the Prior Arts

Most of the conventional nailers are provided with a safety device, however, the safety device only can ensure the safety of the user during nailing course (prevent the nails from being accidentally shot by mistake), but it is unable to stop the nailer from dry firing when no nails are loaded. Thus, there are still some problems will be caused:

First, the user can realize the nails are exhausted only after holding the nailer, aiming at the object and pressing the trigger, this will be a drain on the user's strength and energy.

Second, when the nailer is dry fired in case no nails are loaded, the components inside the nailer will be subjected to a strong impact (because no nail provides a buffering effect), thereby, the service life of the conventional nailer will be shortened.

It is to be noted that there is a safety device on market which can be used to prevent the nailer from dry firing. The drive plate of this safety device projects out of the magazine to stop the safety link, however, if the user presses the safety link without knowing no nails are loaded in the magazine, the press force applied by the user will be acted on the drive plate, causing deformation of the drive plate. Thus, not only the dry firing cannot be prevented, but also the nails will be jammed because of the drive plate deformation.

The present invention has arisen to mitigate and/or obviate the afore-described disadvantages.

SUMMARY OF THE INVENTION

The primary objective of the present invention is to provide a safety device for preventing a nailer from dry firing, wherein the drive plate is provided with a rod which is used to push the safety piece, the safety piece acts as a leverage and the second end of the safety piece serves to work in conjunction with an end of the safety link. After all nails are fired (when no rails are loaded), the second end of the safety piece will move downward to stop the movement of the safety link so as to prevent the nailer from being fired.

The secondary objective of the present invention is to provide a safety device for preventing a nailer from dry firing. When no nails are loaded, the safety device will stop the movement of the safety link by using the safety piece, thus preventing the nailer from strong impact, so that the service life of the nailer is prolonged.

The further objective of the present invention is to provide a safety device for preventing a nailer from dry firing, wherein the movement of the safety link is stopped indirectly by the safety piece. Thereby, the deformation of the drive plate can be prevented.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
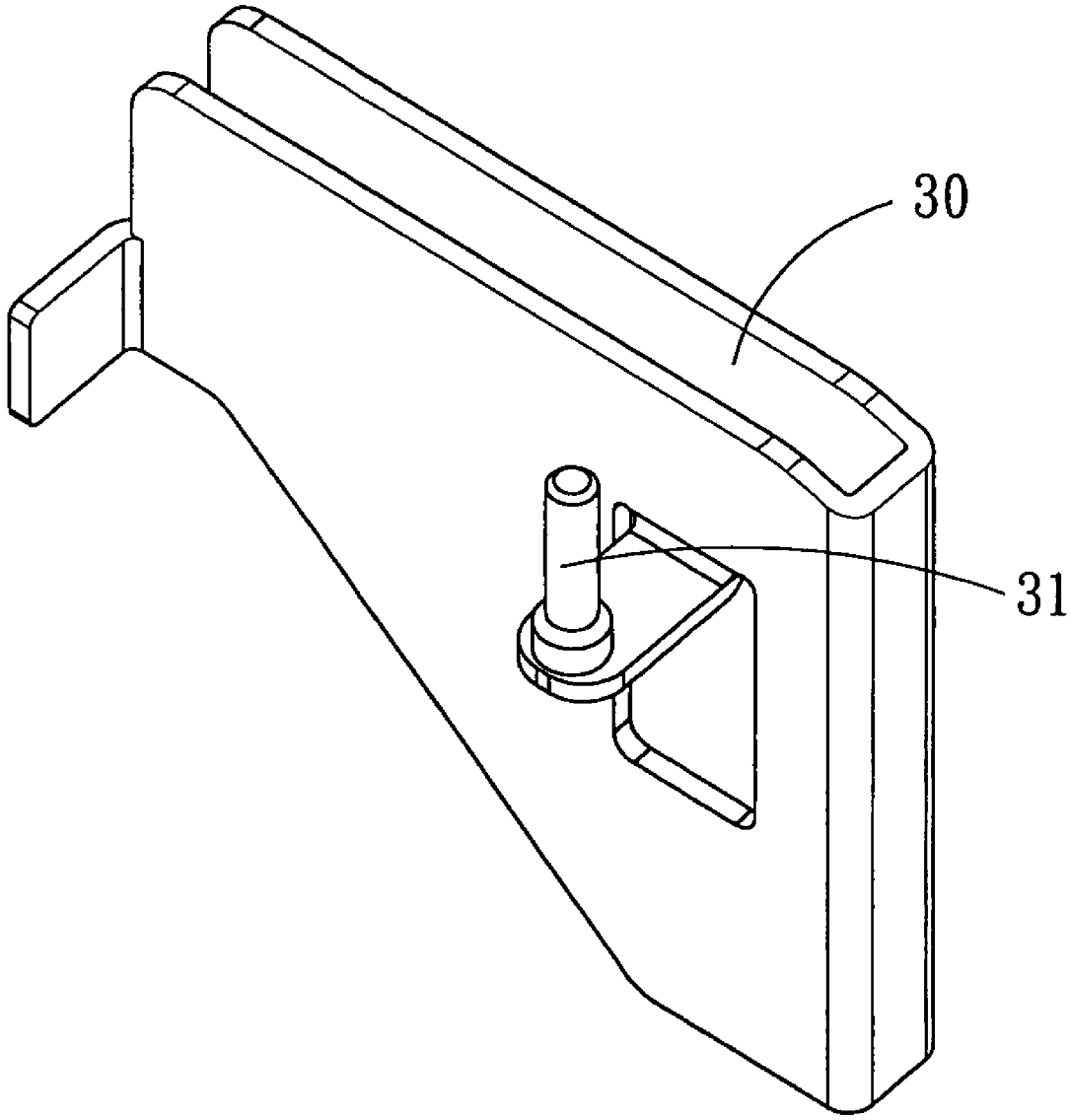
FIG. 1 shows the drive plate in accordance with the present invention.
Figure 2:
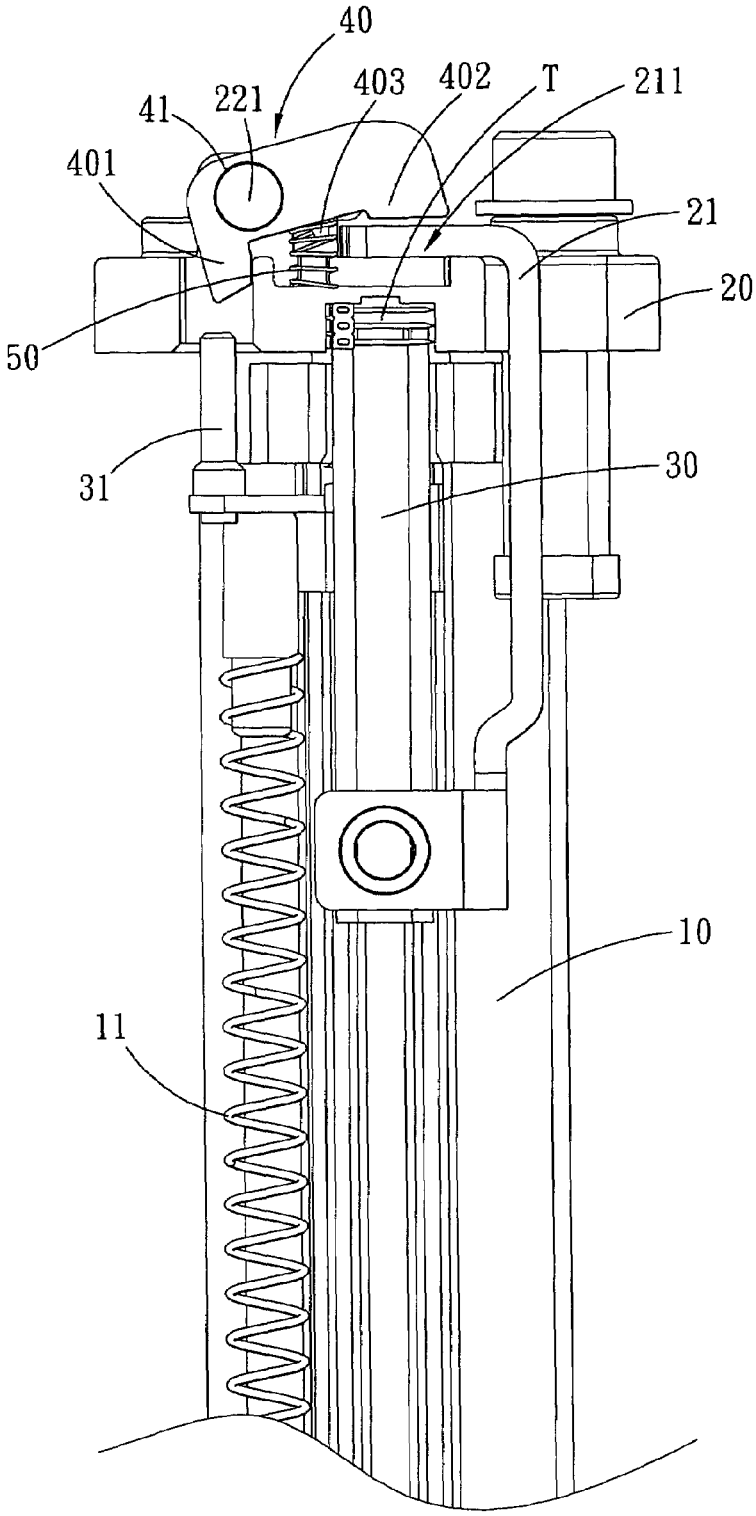
FIG. 2 is an assembly view of showing the safety device in accordance with the present invention when nails are loaded.
Figure 4:
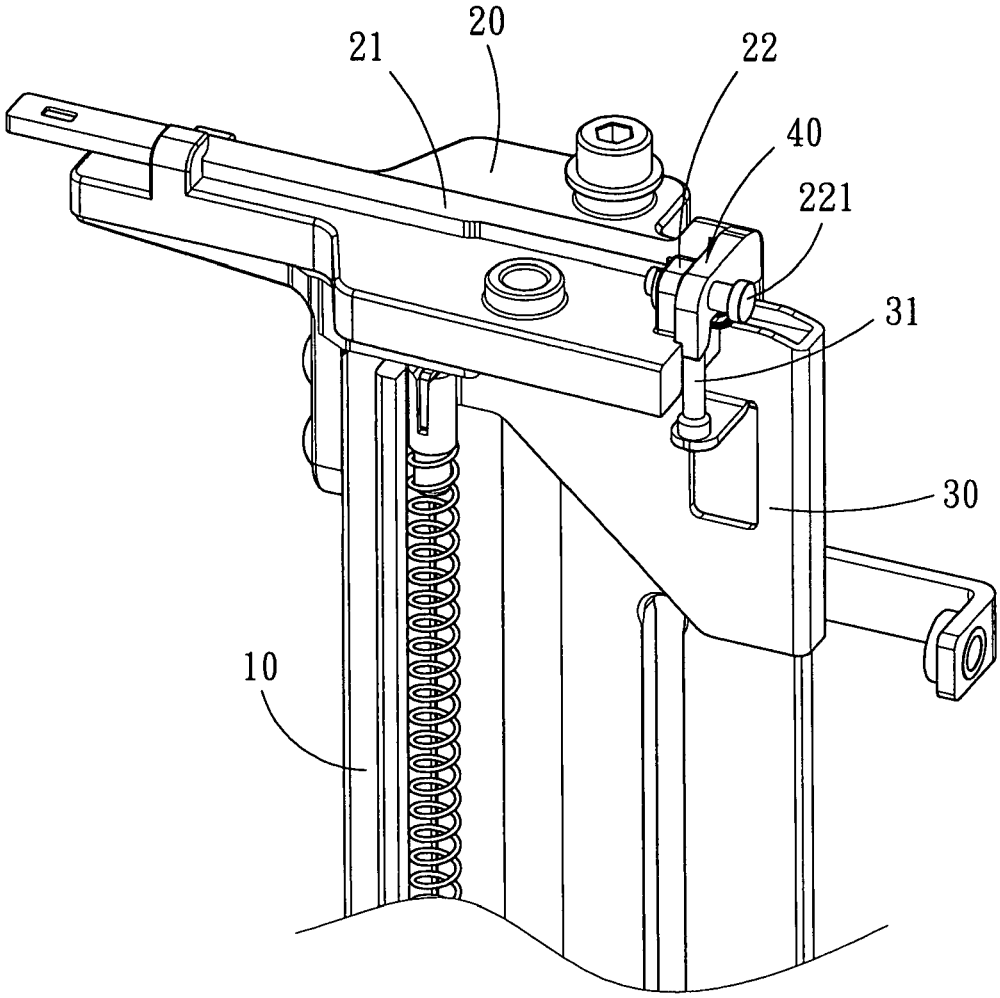
FIG. 4 is a perspective view of showing the safety device in accordance with the present invention.

Referring to FIGS. 1, 2 and 4, a safety device for preventing a nailer from dry firing in accordance with the present invention is shown and includes:

A magazine 10 is installed at the front end of a nailer, and in the magazine 10 is provided a spring 11.

A cover plate 20 is disposed at the topside of the magazine 10, and on the cover plate 20 is slidably provided a safety link 21 which has a folded end 211. At an edge of the cover plate 20 is provided a locking protrusion 22 through which is inserted a pin 221.

A drive plate 30 is assembled on the magazine 10 and works in conjunction with a spring 11 to drive the strip nails T. At a side of the drive plate 30 is provided a rod 31 which is located corresponding to the locking protrusion 22 of the cover plate 20.

A safety piece 40 is provided at its mid portion with a hole 41 through which the pin 221 is inserted so as to fix the safety piece 40 to the locking protrusion 22. A first end 401 of the safety piece 40 corresponds to the rod 31 of the drive plate 30, while a second end 402 of the safety piece 40 corresponds to the folded end 211 of the safety link 21 on the cover plate 20 before the safety link 21 moves (the second end 402 will move downward to stop the movement of the safety link 21). A protrusion 403 is provided beneath the second end 402 of the safety piece 40.

An elastic member 50 is biased between the protrusion 403 and the cover plate 20.

Figure 3:
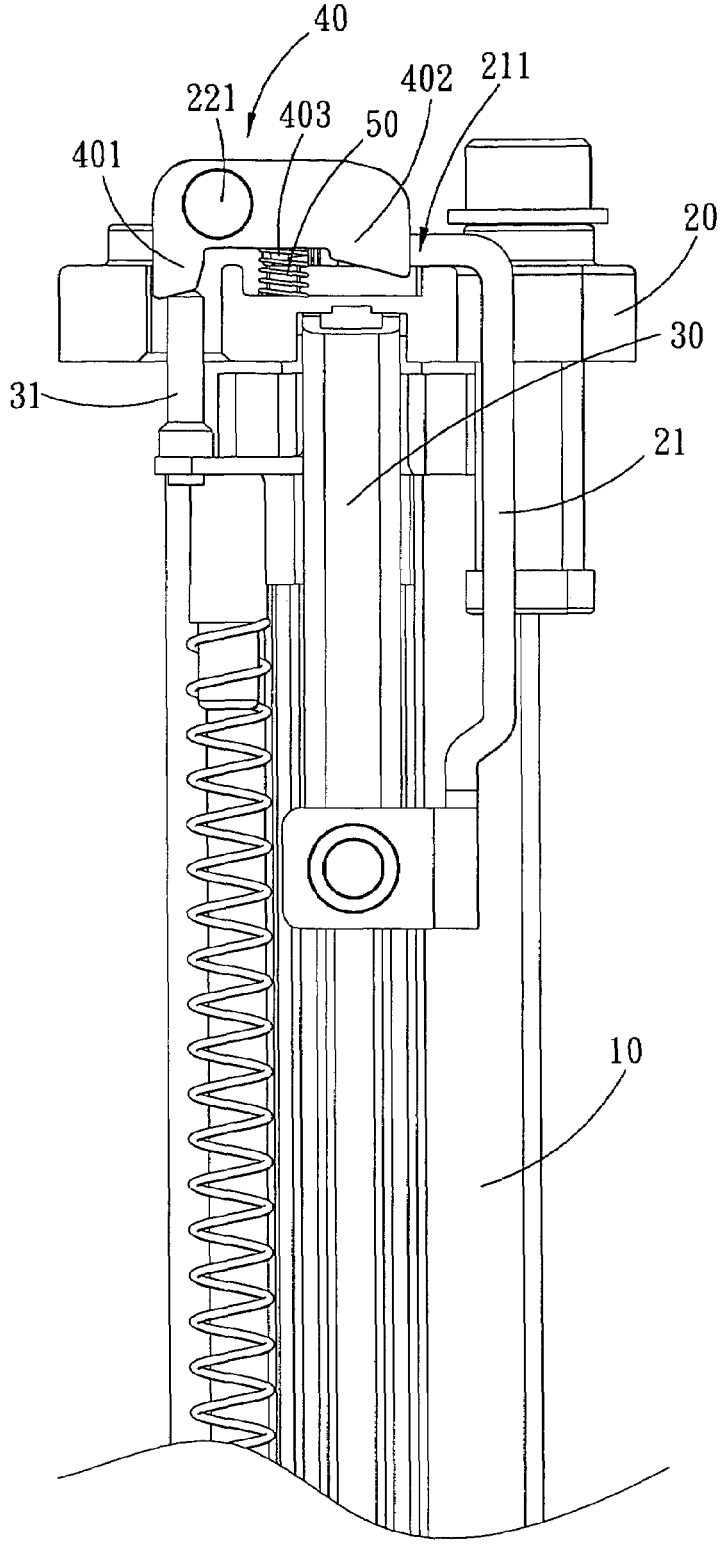
FIG. 3 is an assembly view of showing the safety device in accordance with the present invention when nails are loaded.

Referring further to FIGS. 2 and 3, when the nails T are loaded in the magazine (the drive plate 30 will push against the nails T), the rod 31 on the drive plate 30 is unable to touch the first end 401 of the safety piece 40. Meanwhile, the elastic member 50 keeps pushing against the safety piece 40, so that the safety piece 40 is inclined with the first end 401 located in a lower position and while the second end 402 located in a higher position. The second end 402 will not stop the movement of the safety link 21 since it doesn't stand in the movement path of the folded end 211. Thereby, the nails T can be shot at this moment.

When no nails T are loaded, the drive plate 30 will be moved upward by the spring 11. At this moment, the rod 31 at a side of the drive plate 30 will push the first end 401 of the safety piece 40 to move upward, and the safety piece 40 will act as a leverage with the pin 221 serving as a fulcrum so that the second end 402 of the safety piece 40 will move downward to push against the spring 50 and to stop the movement of the folded end 211 of the safety piece 21, while the first end 401 will move upward. That is to say, when no nails T are loaded, the safety link 10 will be stopped and cannot be pressed down, thereby, the nailer cannot be fired when no nails are loaded. In addition, the safety piece 40 can prevent the nailer from strong impact when no nails are loaded, so that the service life of the nailer is prolonged. By using the safety piece 40 and the safety link 10, the drive plate 30 can be prevented from being deformed by external forces.

Figure 5:
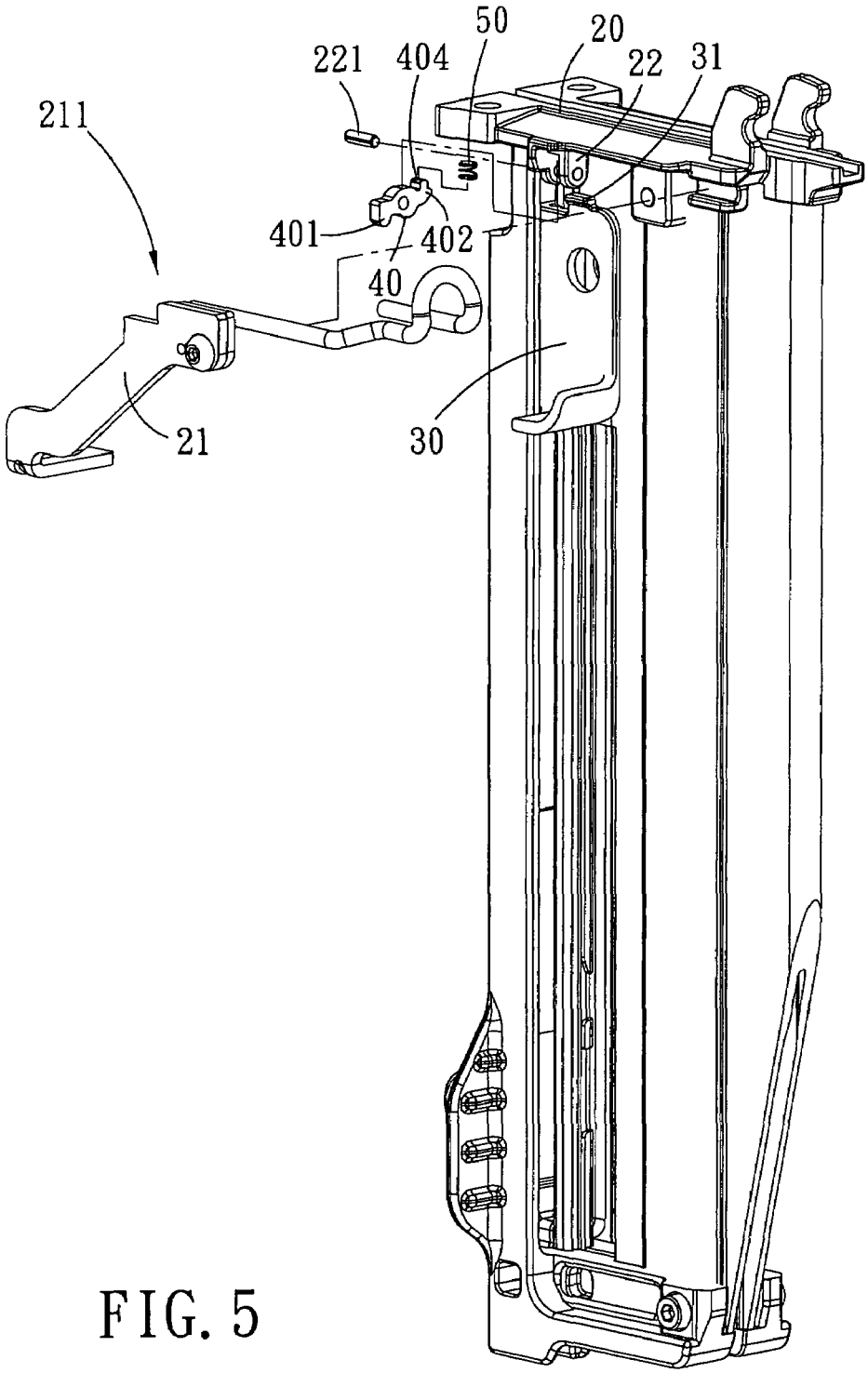
FIG. 5 is an exploded view of showing the safety device in accordance with another embodiment of the present invention.
Figure 6:
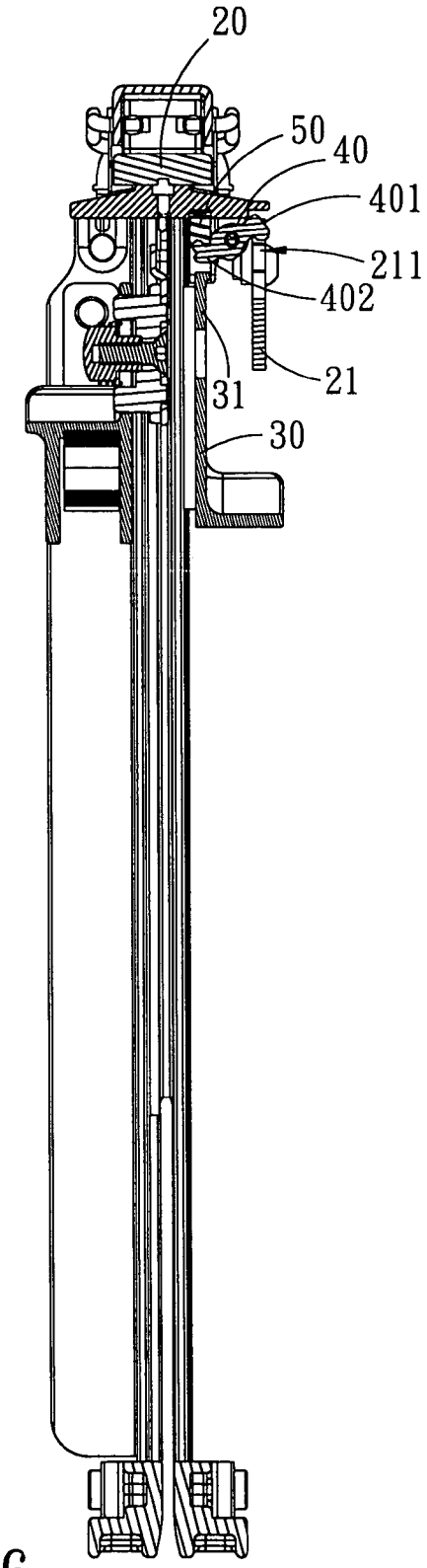
FIG. 6 is an assembly cross sectional view of the safety device in accordance with another embodiment of the present invention, wherein the magazine is loaded.
Figure 7:
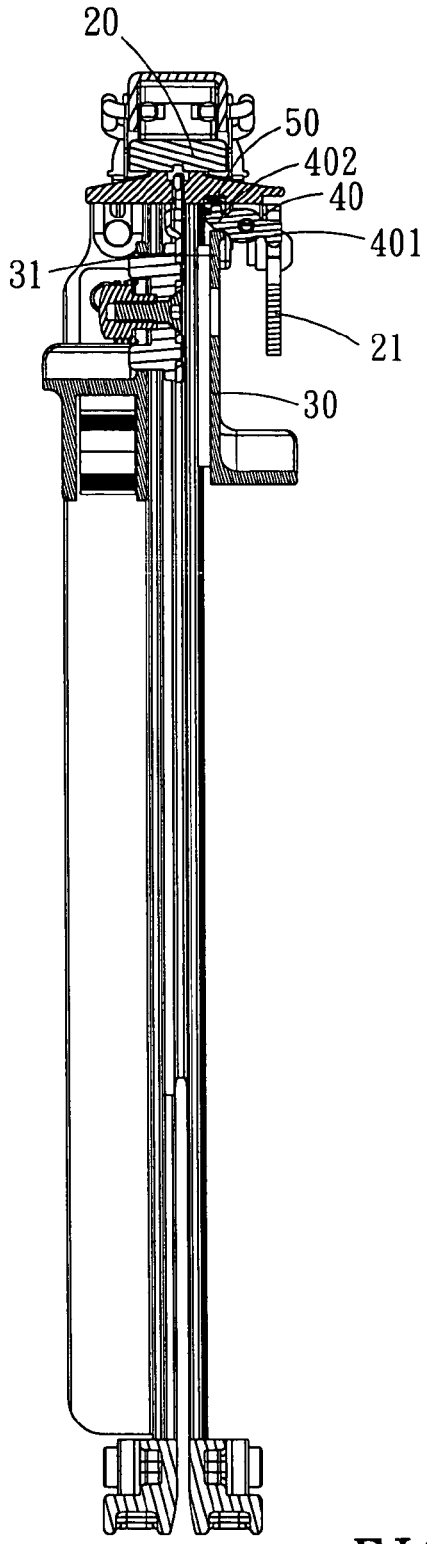
FIG. 7 is an assembly cross sectional view of the safety device in accordance with another embodiment of the present invention when no nails are loaded.

Referring then to FIGS. 5, 6 and 7, a safety device for preventing a nailer from dry firing in accordance with another embodiment of the present invention is shown. In which, the safety piece 40 is pivotally fixed to the locking protrusion 22 of the cover plate 20 by the pin 221, and the locking protrusion 22 is located at the bottom surface of the cover plate 20. Meanwhile, the first end 401 of the safety piece 40 corresponds to folded end 211 of the safety link 21, and the second end 402 corresponds to the rod 31 on the drive plate 30. The protrusion 404 of the safety piece 40 is located above the second end 402, and the elastic member 50 is biased between the protrusion 403 of the safety piece 40 and the cover plate 20. In this embodiment, the position of the first end 401 and that of the second end 402 of the safety piece 40 are exchanged, besides, the whole structure of the safety device is hidden beneath the cover plate 20. This structure also can achieve the same safety effect as the first embodiment.

While we have shown and described various embodiments in accordance with the present invention, it should be clear to those skilled in the art that further embodiments may be made without departing from the scope of the present invention.

What is claimed is:

1. A safety device for preventing a nailer from dry firing, comprising:

a magazine;

a cover plate installed on the magazine, and a safety link slidable on the cover plate;

a drive plate disposed in the magazine for pushing nails, the drive plate provided at a lateral side with a rod corresponding to a locking protrusion of the cover plate;

a safety piece pivotally disposed on the cover plate, a first end of the safety piece engagable with the rod of the drive plate, a second end of the safety piece corresponds to the safety link on the cover plate for preventing movement of the safety link when no nails are loaded in the magazine, and an elastic member biased between the safety piece and the cover plate.

2. The safety device for preventing a nailer from dry firing as claimed in claim 1, wherein the safety piece is pivotally disposed above the cover plate.

3. The safety device for preventing a nailer from dry firing as claimed in claim 2, wherein the locking protrusion is provided at an edge of the cover plate through which is inserted a pin, the safety piece is provided at its mid portion with a hole through which the pin is inserted so as to fix the safety piece to the locking protrusion.

4. The safety device for preventing a nailer from dry firing as claimed in claim 2, wherein a spring is provided in the magazine for working in conjunction with the drive plate to push the nails.

5. The safety device for preventing a nailer from dry firing as claimed in claim 2, wherein the safety piece is provided on the second end with a protrusion for positioning an end of the elastic member.

6. The safety device for preventing a nailer from dry firing as claimed in claim 2, wherein the safety link is provided with a folded end, and the safety piece corresponds to the folded end of the safety link on the cover plate.

7. The safety device for preventing a nailer from dry firing as claimed in claim 1, wherein the safety piece is pivotally disposed below the cover plate.

8. The safety device for preventing a nailer from dry firing as claimed in claim 7, wherein the locking protrusion is provided at an edge of the cover plate through which is inserted a pin, the safety piece is provided at a mid portion with a hole through which the pin is inserted so as to fix the safety piece to the locking protrusion.

9. The safety device for preventing a nailer from dry firing as claimed in claim 7, wherein a spring is provided in the magazine for working in conjunction with the drive plate to push the nails.

10. The safety device for preventing a nailer from dry firing as claimed in claim 7, wherein the safety piece is provided on the second end with a protrusion that is used to position an end of the elastic member.

11. The safety device for preventing a nailer from dry firing as claimed in claim 7, wherein the safety link is provided with a folded end, and the safety piece corresponds to the folded end of the safety link on the cover plate.

* * * * *